US005425469A

United States Patent [19]

Freedland

[11] Patent Number: 5,425,469

[45] Date of Patent: Jun. 20, 1995

[54] LINER CONCEALING TRASH RECEPTACLE

[76] Inventor: Darryle Freedland, 20110 NE. 23rd Ct., North Miami Beach, Fla. 33180

[21] Appl. No.: 177,373

[22] Filed: Jan. 5, 1994

[51] Int. Cl.[6] ..... B65D 25/16

[52] U.S. Cl. ..... 220/404; 220/353

[58] Field of Search ..... 220/404, 353, 352, 356

[56] References Cited

U.S. PATENT DOCUMENTS

| | | | |
|---|---|---|---|
| Re.29,898 | 2/1979 | Wheeler . | |
| D.299,773 | 7/1989 | Kracke . | |
| D.315,625 | 3/1991 | Hallinan et al. . | |
| D.328,510 | 8/1992 | Brussing . | |
| D.332,677 | 1/1993 | Samelson . | |
| D.343,709 | 1/1994 | Doty et al. . | |
| 606,838 | 7/1898 | Heins . | |
| 3,818,956 | 6/1974 | Chamberlain | 220/404 |
| 4,228,916 | 10/1980 | Weingardt . | |
| 4,449,984 | 5/1984 | Cruz | 220/404 |
| 4,466,553 | 8/1984 | Zenger | 220/404 |
| 4,715,572 | 12/1987 | Robbin, III et al. | 220/404 |
| 4,765,579 | 8/1988 | Robbins, III et al. | 220/404 |
| 4,834,261 | 5/1989 | Brdlik | 220/404 |
| 4,913,308 | 4/1990 | Culbertson | 220/404 |
| 4,955,497 | 9/1990 | Winden et al. . | |
| 5,005,727 | 4/1991 | Roth | 220/404 |
| 5,119,960 | 6/1992 | Robbins, III . | |
| 5,160,063 | 11/1992 | Bailey . | |

FOREIGN PATENT DOCUMENTS 105069 1/1963 Netherlands .

*Primary Examiner*—Joseph Man-Fu Moy

*Attorney, Agent, or Firm*—Sixbey, Friedman, Leedom & Ferguson

[57] ABSTRACT

A trash receptacle that both secures and conceals a plastic liner is provided that comprises a receptacle body having side and bottom walls, a receptacle flange having one end secured around the sidewalls of the receptacle body, and a free edge for supporting a portion of the open end of the liner that has been folded over the free edge, and a lid that both secures and covers the folded-over portion of the liner. The lid includes an upper portion having a trash receiving opening, and a lid flange extending downwardly from its upper portion that frictionally interfits in telescopic fashion over the flange extending upwardly from the receptacle body.

14 Claims, 3 Drawing Sheets

LINER CONCEALING TRASH RECEPTACLE

BACKGROUND OF THE INVENTION

This application generally relates to trash receptacles, and is specifically concerned with a liner concealing and securing trash receptacle.

Trash receptacles lined with plastic-bag type liners are not only well known in the prior art, but are in use in practically every home and office in the United States. The use of such liners in trash receptacles not only insulates the interior walls of the receptacle from liquids and sticky substances (which would necessitate frequent cleaning of the receptacles), but further provides a convenient way to empty the trash from such receptacles. To accommodate the wide variety of sizes and shapes of home, office, and commercial trash receptacles, plastic liners of all different sizes are presently available. Such liners are typically formed from thin, water impermeable plastic sheet material that has been formed into a tube having a closed end and an open end. In use, the open end of the liner is spread apart to allow air to enter its interior, whereupon it is placed into the interior of a trash receptacle. The top open portion of the liner is then folded over the upper edge of the trash receptacle. In many instances, the diameter of the plastic liner is chosen to be slightly smaller than the outer diameter of the top of the trash receptacle so that the user must apply some amount of tension to the open end of the liner in order to fold a portion of the open end over the top portion of the receptacle. The tension thus generated by the upper portion of the liner advantageously helps to secure it in position around the open end of the receptacle.

While the folding over of the liner over the open end of the receptacle provides an easy, convenient, and inexpensive way to position the liner within the receptacle, the applicant has observed two major shortcomings associated with the resulting lined receptacles. First, if the diameter of the open end of the liner is the same size or larger than the outer diameter of the upper end of the receptacle, the folding over of the top end of the liner may not adequately secure it to the trash receptacle since there is no tension between the folded-over portion of the bag and the receptacle. Accordingly, as the receptacle is filled with trash, the upper end of the liner may easily be pulled away from its folded-over position. Once this happens, liquid or gummy substances thrown into the receptacle can become lodged between the outer surface of the liner, and the inner walls of the receptacle, thereby necessitating the cleaning of the receptacle. Secondly, the folded-over portion of such plastic liners is unsightly, even when they are formed from translucent or transparent plastic materials. Thus much of the aesthetic effort spent by the designers and manufacturers of trash receptacles is negated by the broad fringe of ugly plastic material that overhangs the upper ends of these receptacles when they are lined with plastic trash bags.

Clearly, what is needed is a trash receptacle which is capable of positively securing and concealing a plastic bag-type liner disposed within its interior. Ideally, such a receptacle would make not only the liner itself, but also the trash disposed within it as unobtrusive as possible. Finally, such a receptacle should be simple to manufacture, compatible with the use of plastic liners of broadly varying dimensions, and aesthetically attractive.

SUMMARY OF THE INVENTION

Generally speaking, the invention is a liner securing and concealing trash receptacle that overcomes all of the aforementioned shortcomings associated with the prior art. The trash receptacle of the invention comprises a receptacle body having an open end, and side and bottom walls for supporting a liner, and a means for both securing and concealing the open upper portion of the liner over the open end of the receptacle body. The securing and concealing means includes a receptacle flange having one end secured around the side walls of the receptacle body, and a free edge for supporting a folded-over portion of the open end of the liner, and a lid that fits over the receptacle flange for both securing and concealing the folded-over portion of the liner. To this end, the lid includes an upper portion having a trash receiving opening, and a lower portion that includes a lid flange which may be slid over the outer surface of the receptacle flange in telescope fashion. The upper edge of the receptacle flange may be circumscribed by a rounded bead, and the inner walls of the lid flange may include a groove that is complementary in shape to the receptacle flange for capturing the same when the flange of the lid is slid completely down over the receptacle flange. When the lid is thus positioned, part of the folded-over portion of the plastic liner is secured between the inter-fitting bead and groove, while the flange of the lid advantageously conceals the balance of the folded-over portion of the plastic liner.

Preferably, the inner walls of the lid flange are complementary in shape to the outer surface of the receptacle flange so that the folded-over portion of the liner is further secured by frictional inter-engagement between these two components. Additionally, the outer surface of the lid flange is preferably the same diameter as the outer surface of the sidewalls so that the lid flange appears to be a continuation of the receptacle side walls when it is placed completely over the receptacle flange, thereby enhancing the overall appearance of the trash receptacle.

The receptacle flange may be connected around the inner diameter of the top edge defining the open end of the receptacle body. In an alternative embodiment, the receptacle flange may be secured around an inner surface of the side walls of the receptacle body. In the second embodiment, the receptacle flange includes a lower portion for spacing the free edge of the flange away from the receptacle side walls, and a central portion that interconnects the lower portion with the free edge. The central portion is long enough to extend the free edge above the top edge of the receptacle body so that the upper portion of a liner may be easily folded over the receptacle flange. In this embodiment, an annular groove is formed between the upper portion of the receptacle body, and the lower portion of the receptacle flange, and the lid flange is rendered complementary in shape to this groove in order to afford a snug fit between the lid and the receptacle body which frictionally secures the folded-over portion of the liner disposed between these components.

In both embodiments of the invention, plastic liners of a variety of different sizes are effectively secured and concealed when the lid flange is slid over the receptacle flange. Additionally, the diameter of the trash receiving opening in the lid is smaller than the outer diameter of the lid in order to further conceal not only the liner, but the trash contained within the receptacle.

BRIEF DESCRIPTION OF THE SEVERAL FIGURES

DETAILED DESCRIPTION OF THE PREFERRED EMBODIMENT

Figure 1A:
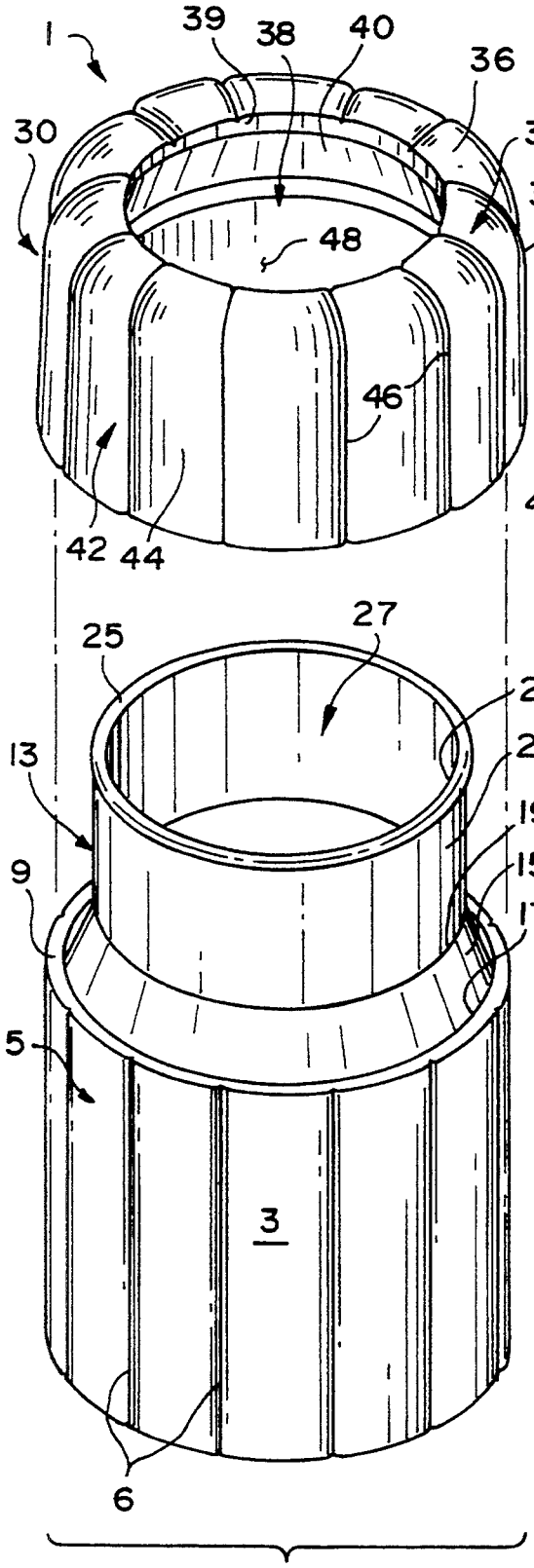
FIG. 1A is an exploded perspective view of a first embodiment of the trash receptacle of the invention shown without a liner.
Figure 1B:
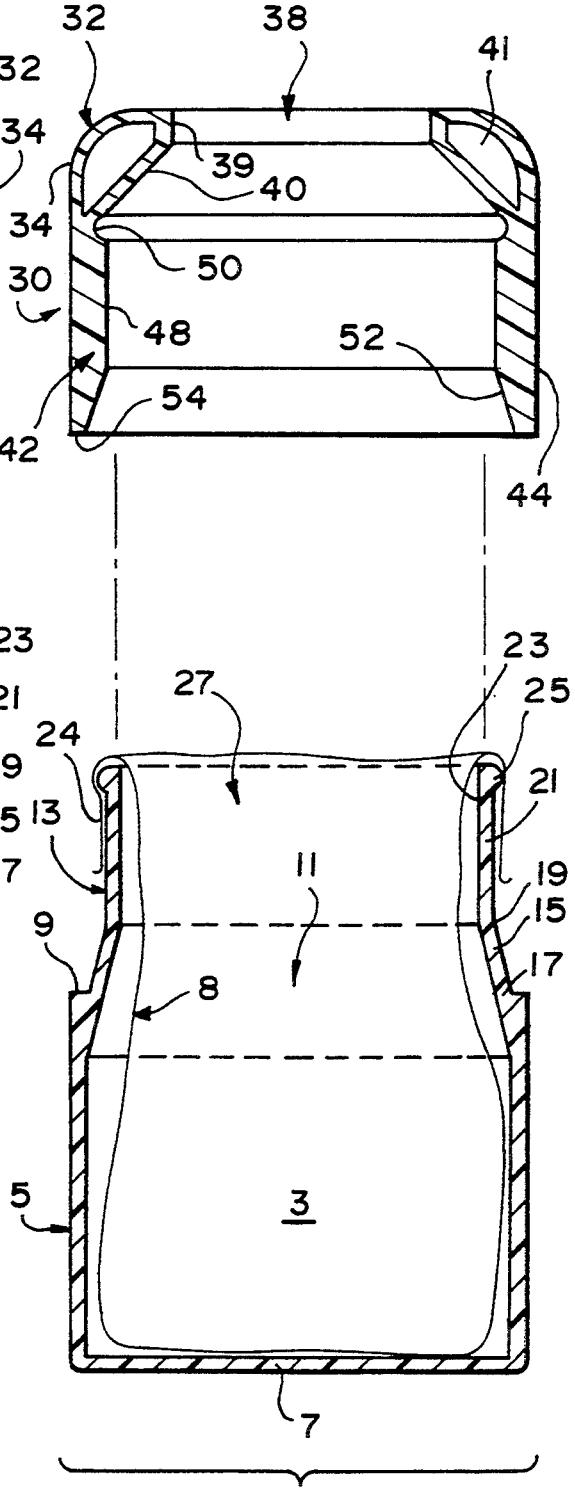
FIG. 1B is a side, cross-sectional view of the trash receptacle illustrated in FIG. 1A with a liner installed in the interior of the receptacle body.

With reference now to FIGS. 1A and 1B, the trash receptacle 1 of the invention includes a receptacle body 3 having tubular sidewalls 5. The exterior of the sidewalls 5 may include a series of vertically oriented flutes 6 for decorative purposes. A circular bottom wall 7 is integrally formed around the bottom edge of the tubular sidewalls 5. The sidewalls 5 and bottom wall 7 may be integrally formed together from a resilient polymeric material. As will be described in more detail hereinafter, the interior of the sidewalls 5 and circular bottom wall 7 may be lined with a tubular plastic liner 8 having a closed bottom end and an open top end. The top of the tubular sidewalls 8 terminates in an annular top edge 9 which defines an open end 11 of the receptacle body 3. Extending upwardly over the annular top edge 9 of the receptacle body 3 is a receptacle flange 13. The flange 13 includes a lower, frustro-conical portion 15. The lower end 17 of frustro-conical portion 15 is integrally connected around the top portion of the sidewalls 5 of the receptacle body 3, while the upper end 19 of this portion 15 is integrally connected to a central annular portion 21 that terminates in a free edge 23. The free edge 23 of the receptacle flange 13 supports a folded-over portion 24 of plastic liner 8. In the embodiment of the invention illustrated in FIGS. 1A and 1B, an annular bead 25 having a semi-annular cross-section circumscribes free edge 23. Free edge 23 defines an open end 27 which is concentric with, albeit somewhat smaller in diameter than, the open end 11 of the receptacle body 3.

Trash receptacle 1 further includes a lid 30 that is frictionally engagable over the receptacle flange 13. The lid 30 includes an upper annular portion 32 having outer sidewalls 34 which are preferably of the same diameter as the tubular sidewalls 5 of the receptacle body. Lid 30 further has an annular top wall that includes a trash receiving opening 38 whose diameter is advantageously smaller than the outer diameter of the receptacle body 3 to help conceal the contents of the receptacle. As may best be seen with respect to FIG. 1B, the trash receiving opening 38 is defined by an annular inner wall 39. The lower edge of inner wall 39 fans out into frustro-conical inner sidewalls 40 as shown. The frustro-conical walls 40 advantageously function to "funnel" trash out of the receptacle 1 when it is desired to empty the receptacle 1 without changing the plastic liner 8 disposed within it. An annular air space 41 is provided around the interior of the upper annular portion 32 of the lid 30 in order to conserve materials, and to lower the weight of the lid 30 as well. Like the previously described receptacle body 3, lid 30 is preferably integrally molded from a flexible polymeric material.

Extending from the bottom of the upper annular portion 32 of the lid 30 is a lid flange 42. In this embodiment of the invention, the outer walls of the lid flange 40 includes flutes 46 alignable with the flutes 6 present in the tubular sidewalls 5 of the receptacle body 3. The provision of such flutes 46 not only helps to create an illusion of continuous integrality between the lid 30 and the receptacle body 3, when these components are assembled, but further provides a more grippable contour around the lid 30 which facilitates its handling by the operator of the invention. The lid flange 32 further includes inner walls 48 which are of approximately the same diameter as the central annular portion 21 of the receptacle flange 13. At their upper ends, the inner walls 48 include an annular groove 50 which is complementary in shape to the semi-cylindrical bead 25 that circumscribes the top edge 9 of the receptacle body 3. At their lower ends, a tapered portion 52 is provided around the inner walls 48 which is the same in shape as the frustro-conical exterior of the lower portion 15 of the receptacle flange 13. The annular tapered portion 52 terminates in a bottom annular edge 54 which is the same size as the annular top edge 9 of the receptacle body 3.

In operation, the lid 30 is removed from the receptacle flange 13 of the body 3, and a plastic liner 8 is spread open and disposed within the interior of the body 3 as shown. Next, the upper open portion 24 of the liner 8 is folded over the receptacle flange 13 in the position shown. Finally, the lid flange 42 is slid over the receptacle flange 13 in telescope fashion until its bottom annular edge 54 engages the annular top edge 9 of the receptacle body 3. When so positioned, the annular bead 25 snap-fits into the annular groove 50 due to the resiliency of the polymeric material or plastic that forms the lid 30. This snap-fit action not only captures and secures the upper portion 24 of the liner 8 over the receptacle flange 13, but the lid 30 to the receptacle flange 13 as well. A frictional securing of the balance of the folded-over portion 24 of the liner 8 is further accomplished as the result of the complementary shape of the inner surface of the lid flange 42 with respect to the outer surface of the receptacle flange 13, which leads to some degree of frictional engagement between these components. When the lid 30 is being slid over the receptacle flange 13, it should be noted that the taper 52 circumscribing the bottom of the lid flange 42 allows such a sliding fit to be accomplished without snagging the folded-over portion 24 of the liner 8.

Figures 2A, 2B:
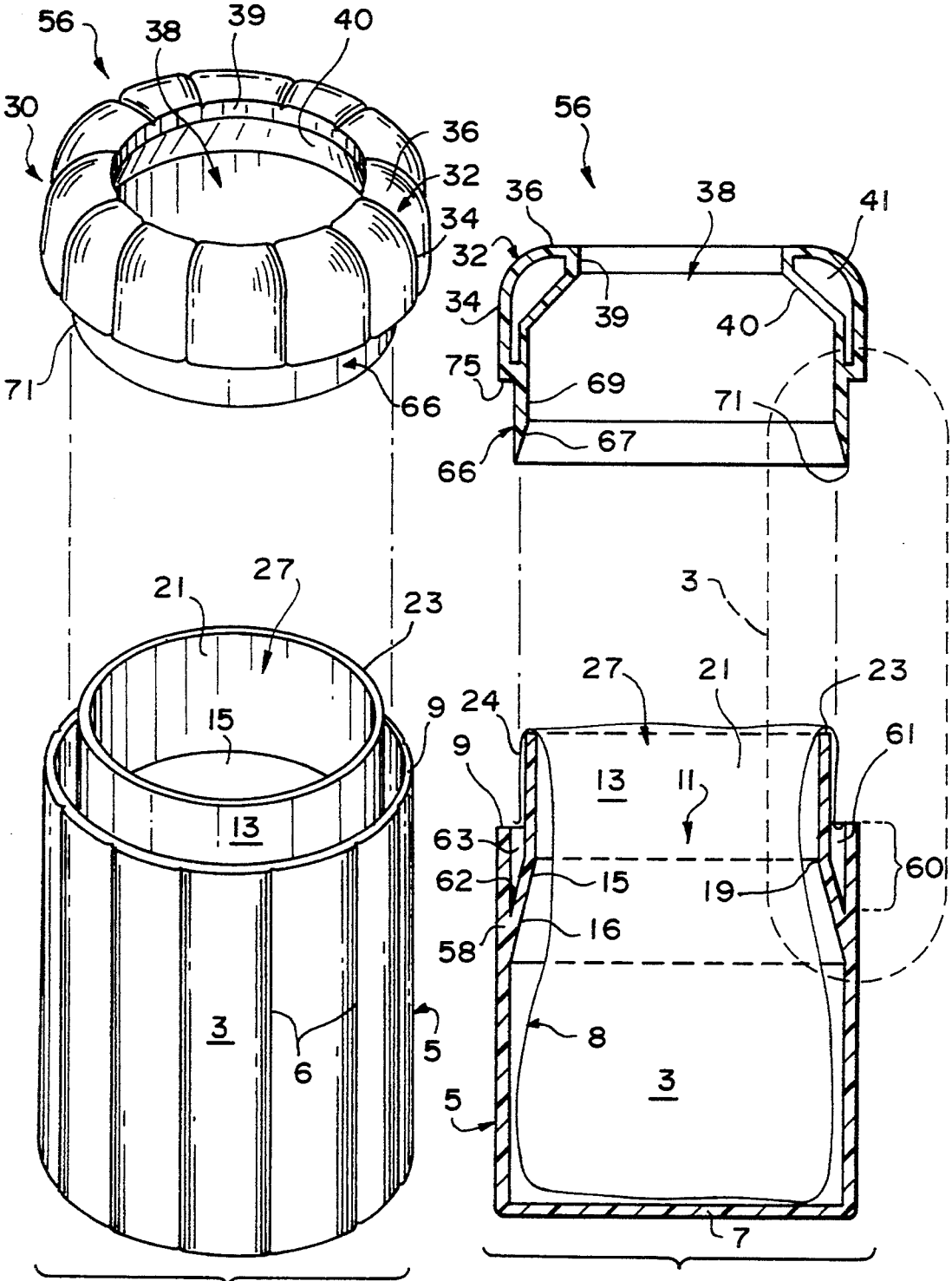
FIG. 2A is an exploded perspective view of a second embodiment of the invention shown without a plastic liner.
FIG. 2B is a side, cross-sectional view of the second embodiment of the trash receptacle illustrated in FIG. 2A with a liner installed in the interior of the receptacle body.

FIGS. 2A and 2B illustrate a second embodiment of the invention. In this embodiment, the bottom end of the receptacle flange 13 is integrally connected around an inner side portion 58 of the receptacle body 3 as shown. Consequently, an upper side wall portion 60 circumscribes the lower portion of the receptacle flange 13, defining an annular groove 61 having a bottom tapered portion 62, and an upper annular portion 63.

In this embodiment, the lid 30 includes a lid flange 66 having a bottom tapered end 64 and an upper annular portion 69 which are complementary in shape to the previously described annular groove 61.

Figure 3:
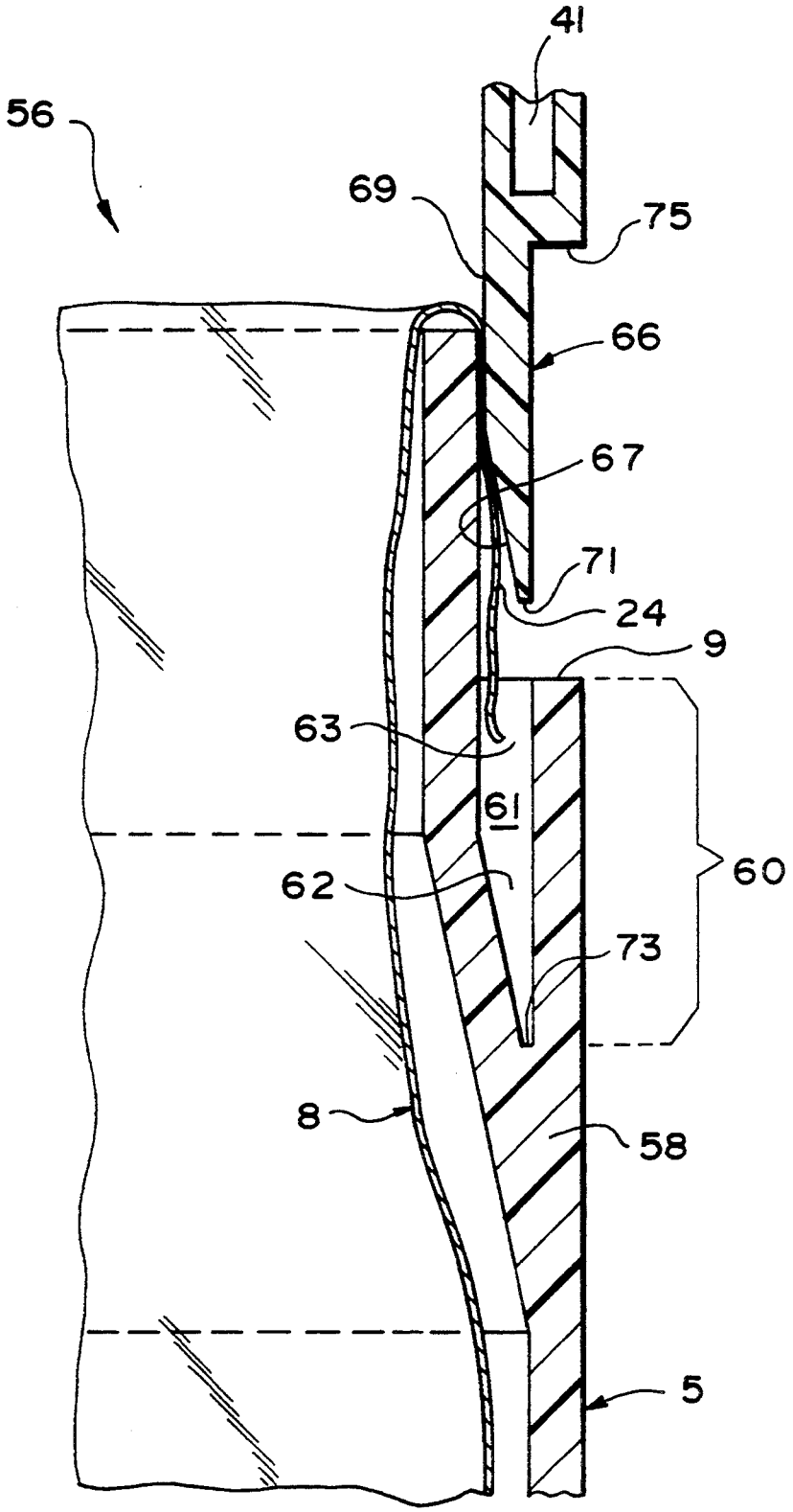
FIG. 3 is an enlargement of the area surrounded by the dotted circle in FIG. 2B, illustrating how the tapered edge of the lid flange may be slid over the folded-over portion of the liner without snagging it.

With reference now to FIGS. 2B and 3, the bottom edge 71 of the flange 66 may be flat as shown and complementary in shape to a bottom wall 73 present at the bottom of the tapered portion 62 of groove 61. Additionally, the lid 30 of the alternate embodiment may include a bottom annular wall 75 which is complementary in shape to the annular top edge 9 of the receptacle body 3. In this embodiment, the lid flange 66 of the lid 30 snugly inter-fits with the complementarily shaped annular groove 61 created between the upper sidewall portion 60 of the receptacle body 3, and the lower portion of the receptacle flange 13. The presence of these inter-fitting components substantially obviates the need for the inter-fitting bead 25 and groove 50 present in the embodiment of the invention illustrated in FIGS. 1A and 1B, as the inter-engagement between lid flange 60 and groove 61 generates frictional forces between the lid flange 66 and the receptacle flange 13 that securely clamp the folded-over portion 24 of the liner 8 in the position shown in FIG. 3. The liner 8 is even more tightly secured to the receptacle 1 in the case where the folded-over portion 24 is inserted deeply with the groove 61, as the tapered shape of the bottom end of the lid flange 66 will tend to wedgingly engage and compress the edge of the liner 8 under such circumstances.

The operation of the second embodiment is evident from the previous description of the operation of the first embodiment taken in conjunction with the foregoing description of the interlocking flange 66 and groove 61.

Although this invention has been described with respect to several preferred embodiments, a number of different embodiment, variations, modifications, and additions to this invention will become evident to persons of ordinary skill in the art. All such embodiments, modifications, variations, and additions are included within the scope of this invention, which is limited only by the claims appended hereto.

What is claimed:

1. A trash receptacle having means for supporting, securing, and concealing a liner, comprising:

(a) a receptacle body having an open end, and side and bottom walls for supporting a liner having an open end defined by an upper edge, and (b) means for securing and concealing an open upper portion of a liner over the open end of the receptacle body, including:

(i) a receptacle flange having an upper portion terminating in a free edge for supporting a portion of an open end of a liner that has been folded over said free edge such that the upper edge of said liner surrounds an outer surface of said flange, and a lower portion secured around an inner surface of said sidewall below the open end of the receptacle body for spacing said flange away from said receptacle sidewalls such that groove means is formed between said lower portion of said flange and said inner surface of said sidewalls for receiving, capturing, and concealing said upper edge of said liner, and (ii) a lid means for covering and concealing said upper edge of said liner, including an upper portion that includes an opening for receiving trash, and a lid flange extending downwardly from said upper portion that is insertable in said groove means for securing said lid means over said receptacle flange and for securing and concealing said folded-over portion of said finer.

2. The finer concealing trash receptacle of claim 1, wherein the outer extent of said receptacle flange is smaller than the outer extent of said receptacle sidewalls, and the outer extent of the lid flange is substantially the same as the outer extent of said receptacle walls such that said lid flange appears to be a continuation of said sidewalls.

3. The liner concealing trash receptacle of claim 1, wherein the free edge of said receptacle flange extends above the open end of the receptacle body to facilitate the folding over of said open end of said liner.

4. The liner concealing trash receptacle of claim 1, wherein said lid flange is complementary in shape to said groove such that said upper end of said liner is frictionally captured between said inner surface of said receptacle sidewalls and said lid flange.

5. The liner concealing trash receptacle of claim 3, wherein said receptacle sidewalls and said flange are formed from a resilient plastic material.

6. The liner concealing trash receptacle of claim 1, wherein the trash receiving opening of the lid means is smaller than a diameter of the lid means, and an upper portion of the lid means includes a funnel portion interconnecting the inner surface of the lid flange with said lid opening for spacing the lid opening from an upper portion of said liner to conceal said liner and for guiding trash disposed in the receptacle out of the lid opening.

7. The liner concealing trash receptacle of claim 1, wherein the lid flange includes a free end that is tapered to prevent said end from snagging said folded-over portion of said liner.

8. A trash receptacle having means for supporting, securing, and concealing a liner, comprising:

(a) a receptacle body having an open end, and side and bottom walls for supporting a liner having an open end defined by an upper edge, and (b) means for securing and concealing the open upper portion of the liner over the open end of the receptacle body, including a receptacle flange having one end secured around an inner surface of said sidewalls below the open end of the receptacle body, and a free edge for supporting a portion of the open end of said liner that has been folded over said edge such that the upper edge of said liner surrounds an outer surface of said flange, and a central portion interconnecting said free edge and secured end that spaces said flange away from the inner surface of the receptacle sidewalls to form a groove means for receiving, capturing, and concealing said upper edge of said liner, the free edge of said flange extending above the open end of the receptacle to facilitate the folding over of said liner thereon, and a lid means for covering said upper edge of said liner and securing it around said flange, said lid means having an upper portion that includes an opening for receiving trash, and a lid flange extending from said lid upper portion that is insertable in said groove means for securing and concealing said folded-over portion of said liner.

9. The liner concealing trash receptacle of claim 8, wherein said lid flange is complementary in shape to said groove such that said upper end of said liner is frictionally captured between said inner surface of said receptacle sidewalls and said lid flange.

10. The liner concealing trash receptacle of claim 8, wherein the lid flange includes a free end that is tapered to prevent said end from snagging said folded-over portion of said liner.

11. The liner concealing trash receptacle of claim 10, wherein said tapered end assists in securing said lid means to said receptacle body by wedgingly engaging the groove formed between said receptacle sidewalls, and said receptacle flange.

12. A trash receptacle having means for supporting, securing, and concealing a liner, comprising:

(a) a receptacle body having an open end, and side and bottom walls for supporting a liner having an open end defined by an upper edge, and (b) means for securing and concealing an open upper portion of the liner over the open end of the receptacle body, including:

(i) a receptacle flange having one end secured around said sidewalls, and a free edge for supporting a portion of the open end of said liner that has been folded over said free edge such that the upper edge of said liner surrounds an outer surface of said flange, and (ii) a lid means for covering said upper edge of said liner, including an upper portion that includes an opening for receiving trash, and a lid flange extending downwardly from said upper portion for securing said lid means over said receptacle flange and for covering said folded-over portion of said liner, said lid flange including an inner surface, at least a portion of which frictionally engages the outer surface of the receptacle flange to frictionally secure said folded-over portion of said liner between said flanges, wherein the receptacle flange is secured around an upper edge of the sidewalls, and the outer extent of said receptacle is smaller than the outer extent of said receptacle sidewalls, and the outer extent of the lid flange is substantially the same as the outer extent of said receptacle walls such that said lid flange appears to be a continuation of said sidewalls.

13. The liner concealing trash receptacle of claim 12, wherein the receptacle flange has a lower portion secured around an inner surface of said sidewalls for spacing the flee edge of said flange away from said receptacle sidewalls, and the free edge of said receptacle flange extends above the open end of the receptacle body to facilitate the folding over of said open end of said liner, and said receptacle flange includes a central portion integrally connected to said lower flange portion on one end and terminating in said free edge on its other end, such that a groove means is formed between said receptacle sidewalls, and said lower and central portions of said receptacle flange for receiving, capturing, and concealing said folded-over portion of said liner.

14. A trash receptacle having means for supporting, securing, and concealing a liner, comprising:

(a) a receptacle body having an open end, and side and bottom walls for supporting a liner having an open end defined by an upper edge, and (b) means for securing and concealing an open upper portion of the liner over the open end of the receptacle body, including:

(i) a receptacle flange having one end secured around said sidewalls, and a free edge for supporting a portion of the open end of said liner that has been folded over said free edge such that the upper edge of said liner surrounds an outer surface of said flange, and (ii) a lid means for coveting said upper edge of said liner, including an upper portion that includes an opening for receiving trash, and a lid flange extending downwardly from said upper portion for securing said lid means over said receptacle flange and for covering said folded-over portion of said liner, wherein the receptacle flange has a lower portion secured around an inner surface of said sidewalls for spacing the free edge of said flange away from said receptacle sidewalls, and the free edge of said receptacle flange extends above the open end of the receptacle body to facilitate the folding over of said open end of said liner, and said receptacle flange includes a central portion integrally connected to said lower flange portion on one end and terminating in said free edge on its other end, such that a groove means is formed between said receptacle sidewalls, and said lower and central portions of said receptacle flange for receiving, capturing, and concealing said folded-over portion of said line, and wherein said lid flange is complementary in shape to said groove for capturing said upper end of said liner between said inner surface of said receptacle sidewalls and said lid flange.

* * * * *